US006606463B2

(12) United States Patent
Gross et al.

(10) Patent No.: US 6,606,463 B2
(45) Date of Patent: Aug. 12, 2003

(54) OPTICAL TONER CONCENTRATION SENSOR

(75) Inventors: Eric M. Gross, Rochester, NY (US); Scott M. Silence, Fairport, NY (US); Ralph A. Shoemaker, Rochester, NY (US); Douglas A. Kreckel, Webster, NY (US); Jean A. Maksymiak, Fairport, NY (US); Raymond L. Mongeon, Rochester, NY (US); Joseph A. Mastrandrea, Webster, NY (US); R. Enrique Viturro, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/012,442

(22) Filed: Dec. 12, 2001

(65) Prior Publication Data

US 2003/0113126 A1 Jun. 19, 2003

(51) Int. Cl.[7] ..... G03G 15/08
(52) U.S. Cl. ..... 399/30; 399/64; 399/65
(58) Field of Search ..... 399/27–30, 61, 399/62, 64, 65; 118/691

(56) References Cited

U.S. PATENT DOCUMENTS 3,610,205 A * 10/1971 Rarey et al. ..... 399/30
3,873,002 A 3/1975 Davidson et al. ..... 222/56
4,318,610 A 3/1982 Grace
4,326,646 A 4/1982 Lavery et al. ..... 222/56
4,348,099 A 9/1982 Fantozzi
4,956,669 A 9/1990 Nakamura
4,980,727 A * 12/1990 Stelter ..... 399/64
4,989,985 A 2/1991 Hubble, III et al. ..... 356/445
5,081,491 A 1/1992 Lux et al.
5,117,259 A * 5/1992 Etou et al. ..... 399/65
5,383,007 A * 1/1995 Kinoshita et al. ..... 399/65
5,519,497 A 5/1996 Hubble, III et al. ..... 356/445
5,530,530 A * 6/1996 Tanaka et al. ..... 399/64
5,860,041 A * 1/1999 Tanaka et al. ..... 399/65

* cited by examiner

*Primary Examiner*—William J. Royer
(74) *Attorney, Agent, or Firm*—Lloyd F. Bean, II

(57) ABSTRACT

A toner maintenance system for an electrophotographic developer unit, including a sump for storing a quantity of developer material comprised of toner material; a first member for transporting developer material from the sump, a viewing window, in communication with toner material, in the sump; an optical sensor, for measuring reflected light off the viewing window and toner material, and generating a signal indicative thereof. A toner concentration controller is adapted to receive a signal from the optical sensor and to generate an "Add Toner" signal to replenish toner material in the sump.

12 Claims, 3 Drawing Sheets

OPTICAL TONER CONCENTRATION SENSOR

Reference is made to commonly-assigned copending U.S. pat. application Ser. No. 10/012,440, concurrently filed herewith, entitled "DEVELOPER COMPOSITION HAVING IMPROVED NOISE SIGNAL RATIO IN AN OPTICAL TONER CONCENTRATION SENSING SYSTEM," by Gross et al., the disclosure of which is incorporated herein.

This invention relates generally to a printing machine, and more particularly concerns an apparatus for controlling the concentration of toner in a development system of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductive member or is cleaned by a cleaning device.

In a machine of the foregoing type, it is desirable to regulate the addition of toner particles to the developer material in order to ultimately control the triboelectric characteristics (tribo) of the developer material. However, control of the triboelectric characteristics of the developer material are generally considered to be a function of the toner concentration within the developer material. Therefore, for practical purposes, machines of the foregoing type usually attempt to control the concentration of toner particles in the developer material.

Toner tribo is a very "critical parameter" for development and transfer. Constant tribo would be an ideal case. Unfortunately, it varies with time and environmental changes. Since tribo is almost inversely proportional to Toner Concentration (TC) in a two component developer system, the tribo variation can be compensated for by the control of the toner concentration.

Toner Concentration is conventionally measured by a Toner Concentration (TC) sensor. The problems with TC sensors are that they are expensive, not very accurate, and rely on an indirect measurement technique which has poor signal to noise ratio.

Various approaches have been devised for controlling the concentration of toner in a development system. The following disclosures appear to be relevant:

U.S. Pat. No. 3,873,002 granted to Davidson et al. describes a control device which regulates the dispensing of predetermined quantities of particles from a storage container to a mix for maintaining the concentration thereof substantially at a preselected level. Specifically, a detecting means is used to determine the toner concentration and to signal a count detector. Subsequently, control logic analyzes the value contained in the count detector to determine whether a half or full toner dispense cycle is required.

U.S. Pat. No. 4,318,610 granted to Grace describes an apparatus in which toner particle concentration within a developer mixture and charging of the photoconductive surface are controlled. More specifically, an infrared densitometer generates electrical signals proportional to the developed toner mass of test areas on the photoconductive surface. The signals are fed through a conversion circuit and subsequently interpreted by a controller. The controller energizes a toner dispense motor, via a logic interface, whenever the detected density of a toner concentration test patch is below a nominal level. In addition, successive energizing of the toner dispense motor without an increase in detected density results in the generation of a "toner container empty" signal by the controller.

U.S. Pat. No. 4,326,646 granted to Lavery et al. discloses an automatic development control system utilizing a control loop to vary the time period of activation of a toner dispenser. The toner dispenser is activated for a predetermined fraction of the copy cycle depending upon the relative density of a test patch versus a desired density. For example, when the detected test patch toner density is first indicated as low, the toner dispenser is activated for a period of 0.5 seconds. For successive indications of a low toner density the toner dispenser is activated in increments of 0.5 seconds up to a maximum period of 1.5 seconds.

U.S. Pat. No. 4,348,099 granted to Fantozzi teaches a sample data control system for controlling charge, illumination, toner dispensing, and developer bias. The system disclosed utilizes a toner dispensing control loop for regulating toner, wherein the control loop responds to a signal from an infrared sensor which detects the density of a developed test patch. Specifically, the voltage level from the sensor is compared against a reference voltage. If the voltage from the sensor is indicative of a toner density less than the desired density, a dispense motor is activated at a low or high rate. Once the toner density is determined to be sufficiently greater than the desired density, the dispense motor is turned off. This control process continues with the dispense motor being activated as required and the adjustment or activation of the toner dispenser being made if required preferably after each even copy cycle.

U.S. Pat. No. 4,956,669 granted to Nakamura describes a control apparatus for controlling the concentration of toner incorporated in developing material by means of controlling toner replenishment. Specifically, a toner concentration detecting sensor signal is analyzed to detect an abnormal sensor condition. When such a situation occurs, toner is dispensed at a constant volume. If the sensor is operating normally, an average signal level is used to determine the toner volume to be dispensed.

U.S. Pat. No. 5,081,491 granted to Lux et al. describes an apparatus for controlling the concentration of toner within a developer material of carrier and toner. The apparatus having a control means for generating a toner addition signal indicative of the amount of toner to be added to the developer material. The control means including the ability to measure the concentration of toner within the developer material during at least a first period and a second period subsequent to the first period. The control means also determining a first concentration error as a function of the deviation between the toner concentration measured during the first period and a reference toner concentration and a second concentration error as a function of the deviation between the toner concentration measured during the second period and the reference toner concentration. Subsequently, the control means generates the toner addition signal as a function of the first and second concentration error values. The apparatus also includes means, responsive to the toner addition signal, for regulating the addition of toner to said developer material.

In accordance with one aspect of the present invention, there is provided a toner maintenance system for an electrophotographic developer unit, comprising: a sump for storing a quantity of developer material comprised of toner material; a member for transporting developer material from said sump, a viewing window, in communication with developer material, in said sump; an optical sensor for measuring reflected light off said viewing window and developer material, and means for generating a signal indicative of the toner concentration in said sump.

Pursuant to another aspect of the present invention, there is provided an electrophotographic printing machine having a toner maintenance device in which a toner image is developed on a photoreceptive member, having a toner maintenance device, comprising: a sump for storing a quantity of developer material comprised of toner material; a member for transporting developer material from said sump, a viewing window, in communication with developer material, in said sump; an optical sensor for measuring reflected light off said viewing window and developer material, and generating a signal indicative of the toner concentration in said sump.

Pursuant to yet another aspect of the present invention, there is provided an apparatus for measuring toner concentration of a sample composed of toner and carrier, the apparatus comprising: a viewing window, in communication with the sample, an optical sensor for measuring reflected light off said viewing window and sample, and means for generating a signal indicative of the toner concentration.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
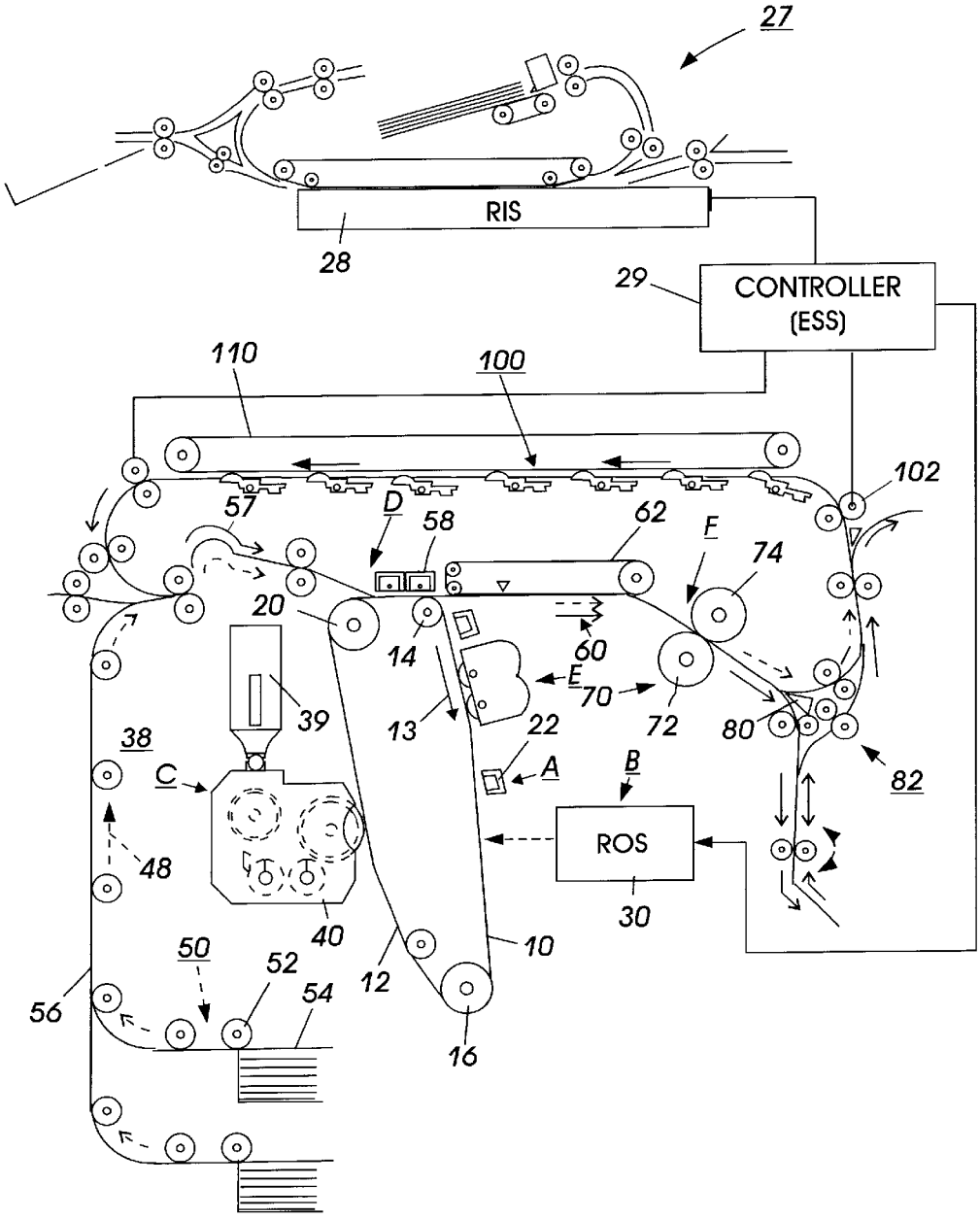
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS 28 contains document illumination lamps, optics, a mechanical scanning drive and a charge coupled device (CCD) array. The RIS 28 captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. The photoconductive belt 10 moves in the direction of arrow 13 to advance successive portions sequentially through the various processing stations disposed about the path of movement thereof. The photoconductive belt 10 is entrained about stripping roller 14, tensioning roller 16 and drive roller 20. As drive roller 20 rotates, it advances photoconductive belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example a raster output scanner (ROS), indicated generally by reference numeral 30. Preferably, ESS 29 is a self-contained, dedicated minicomputer. The image signals transmitted to ESS 29 may originate from a RIS 28 as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS 30 illuminates the charged portion of photoconductive belt 10 at a resolution of about 300 or more pixels per inch. The ROS 30 will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, photoconductive belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor as described below.

With continued reference to FIG. 1, after the electrostatic latent image is developed, the toner powder image present on photoconductive belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the sheet 48. Preferably, fuser assembly 70 includes a heated fuser roller 72 and a pressure roller 74 with the powder image on the sheet 48 contacting fuser roller 72.

The sheet 48 then passes through fuser assembly 70 where the image is permanently fixed or fused to the sheet 48. After passing through fuser assembly 70, a gate 80 either allows the sheet 48 to move directly via an output to a finisher or stacker, or deflects the sheet 48 into the duplex path 100, specifically, first into single sheet inverter 82. That is, if the sheet 48 is either a simplex sheet, or a completed duplex sheet having both side one and side two images formed thereon, the sheet 48 will be conveyed via gate 80 directly to the output. However, if the sheet 48 is being duplexed and is then only printed with a side one image, the gate 80 will be positioned to deflect that sheet 48 into the inverter 82 and into the duplex path 100, where that sheet 48 will be inverted and then fed to acceleration nip 102 and belt transports 110, for recirculation back through transfer station D and fuser assembly 70 for receiving and permanently fixing the side two image to the backside of that duplex sheet, before it exits via an exit path.

After the print sheet 48 is separated from photoconductive surface 12 of photoconductive belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller 29 is preferably a programmable microprocessor which controls all of the machine functions hereinbefore described including toner dispensing. The controller 29 provides a comparison count of the copy sheets, the number of documents being recirculated, the number of copy sheets selected by the operator, time delays, jam corrections, and the like. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
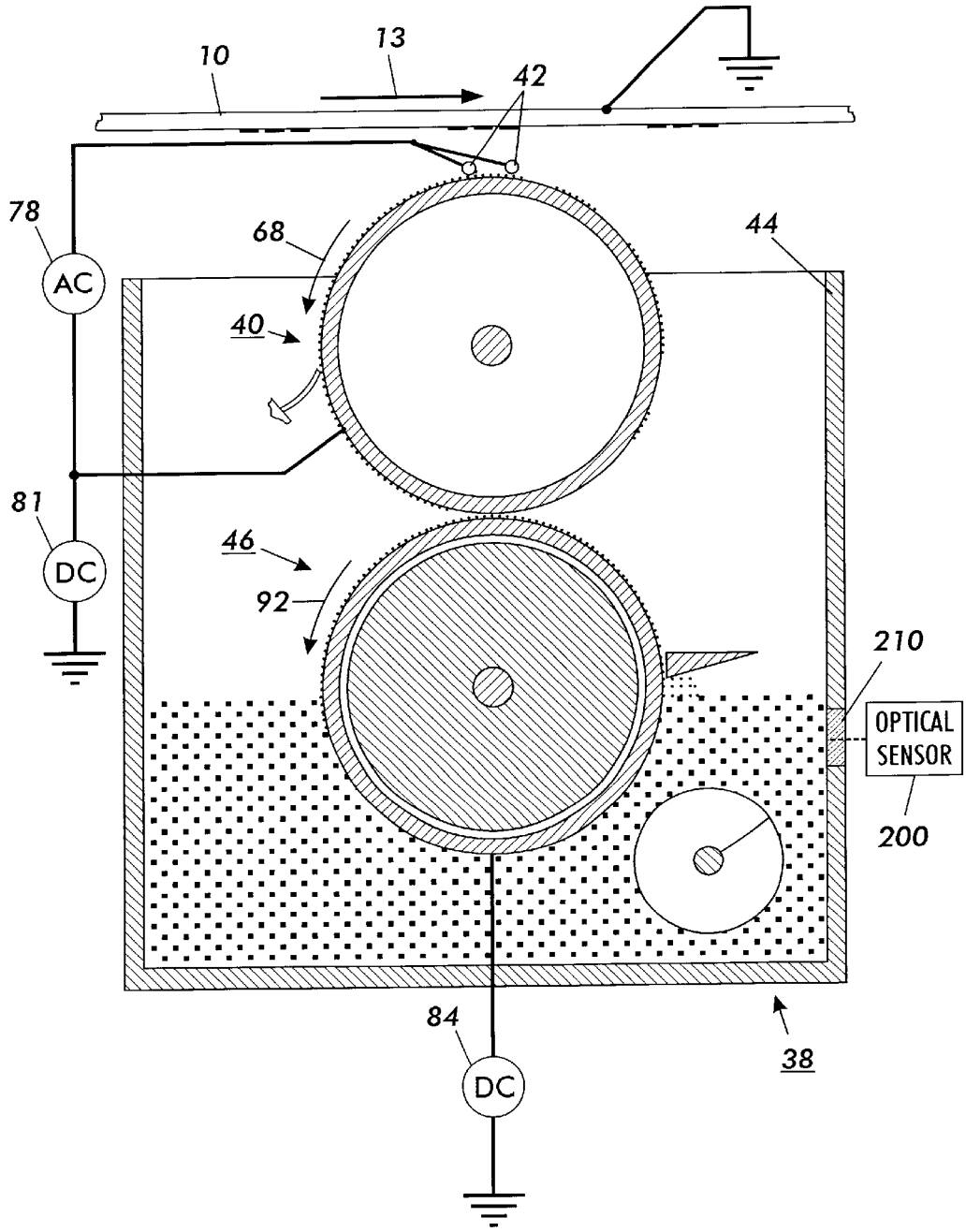
FIG. 2 is a schematic elevational view of the development system utilizing the invention herein.
Figure 3:
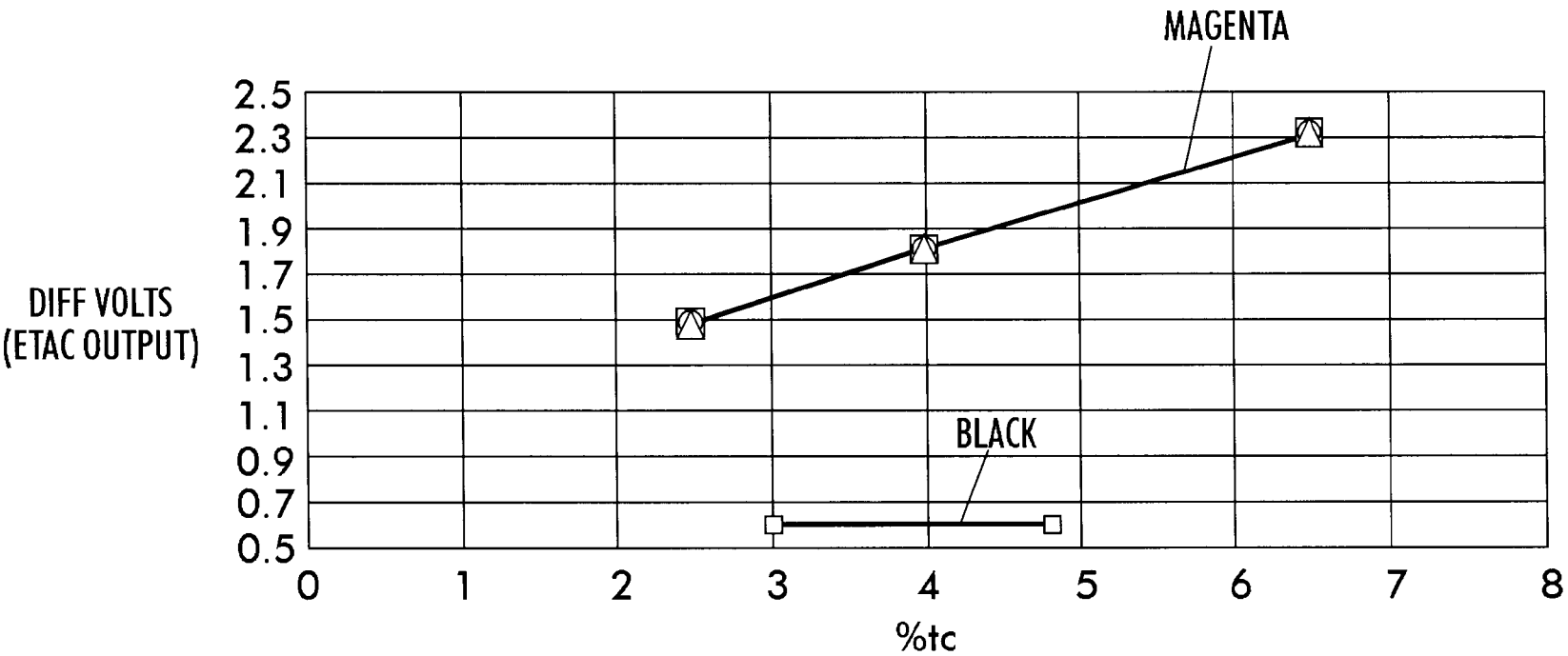
FIG. 3 is a graph illustrating the diffused light output data which indicates that toner concentration as a function of diffused light.

Turning now to FIGS. 2 and 3, there is shown developer unit 38 in greater detail. More specifically a hybrid developer unit is shown where toner is loaded onto a donor roller 40 from a second roller (e.g. a magnetic brush roller 46). The toner is developed onto the photoconductive belt 10 from the donor roller 40 using one of many techniques which include: wire scavengeless, embedded wire scavengeless, AC jumping, DC jumping, and contact. As shown thereat, developer unit 38 includes a housing 44 defining a chamber for storing a supply of developer material therein. Donor roller 40, electrode wires 42 and magnetic roller 46 are mounted in the chamber of housing 44. The donor roller 40 can be rotated in either the 'with' or 'against' direction relative to the direction of motion of the photoconductive belt 10.

In FIG. 2, donor roller 40 is shown rotating in the direction of arrow 68, i.e. the 'against' direction. Similarly, the magnetic roller 46 can be rotated in either the 'with' or 'against' direction relative to the direction of motion of donor roller 40. In FIG. 2, magnetic roller 46 is shown rotating in the direction of arrow 92, i.e. the 'with' direction. Developer unit 38 also has electrode wires 42 which are disposed in the space between the photoconductive belt 10 and donor roller 40. A pair of electrode wires 42 are shown extending in a direction substantially parallel to the longitudinal axis of the donor roller 40. The electrode wires 42 are made from one or more thin (i.e. 50 to 100$\mu$ diameter) wires (e.g. made of stainless steel or tungsten) which are closely spaced from donor roller 40. The distance between the electrode wires 42 and the donor roller 40 is approximately 25$\mu$ or the thickness of the toner layer on the donor roller 40. The electrode wires 42 are self-spaced from the donor roller 40 by the thickness of the toner on the donor roller 40. To this end the extremities of the electrode wires 42 supported by the tops of end bearing blocks also support the donor roller 40 for rotation. The ends of the electrode wires 42 are now precisely positioned between 10 and 30 microns above a tangent to the surface of donor roller 40.

With continued reference to FIG. 2, an alternating electrical bias is applied to the electrode wires 42 by an AC voltage source 78. The applied AC establishes an alternating electrostatic field between the electrode wires 42 and the donor roller 40 which is effective in detaching toner from the surface of the donor roller 40 and forming a toner cloud about the wires, the height of the cloud being such as not to be substantially in contact with the photoconductive belt 10. The magnitude of the AC voltage is on the order of 200 to 500 volts peak at a frequency ranging from about 3 kHz to about 10 kHz. A DC bias supply 81 which applies approximately 300 volts to donor roller 40 establishes an electrostatic field between photoconductive surface of belt 10 and donor roller 40 for attracting the detached toner particles from the cloud surrounding the electrode wires 42 to the latent image recorded on the photoconductive surface 12. At a spacing ranging from about 10$\mu$ to about 40$\mu$ between the electrode wires 42 and donor roller 40, an applied voltage of 200 to 500 volts produces a relatively large electrostatic field without risk of air breakdown. The use of a dielectric coating on either the electrode wires 42 or donor roller 40 helps to prevent shorting of the applied AC voltage.

Magnetic roller 46 meters a constant quantity of toner having a substantially constant charge onto donor roller 40. This insures that the donor roller provides a constant amount of toner having a substantially constant charge as maintained by the present invention in the development gap.

A DC bias supply 84 which applies approximately 100 volts to magnetic roller 46 establishes an electrostatic field between magnetic roller 46 and donor roller 40 so that an electrostatic field is established between the donor roller 40 and the magnetic roller 46 which causes toner particles to be attracted from the magnetic roller 46 to the donor roller 40.

An optical sensor 200 is positioned adjacent to transparent viewing window 210 which is in visual communication with housing 44. Preferably, transparent viewing window 210 is positioned in a place where the developer material, is well mixed near an auger supplying the magnetic roller 46 thereby a toner concentration representative of the overall housing 44, can be obtained.

The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and toner on transparent viewing window 210, is received by the optical sensor 200. In response to the signals, the amount of toner concentration can be calculated.

The optical sensor 200 detects specular and diffuse electromagnetic energy reflected off developer material on transparent viewing window 210. Preferably the optical sensor 200 is a type employed in an Extended Toner Area Coverage Sensor (ETACS) Infrared Densitometer (IRD) such as an optimized color densitometers (OCD), which measures material density located on a substrate by detecting and analyzing both specular and diffuse electromagnetic energy signal reflected off of the density of material located on the substrate as described in U.S. Pat. Nos. 4,989,985 and 5,519,497 which is hereby incorporated by reference. The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and developer material on transparent viewing window 210, is received by the optical sensor 200. In response to the signals, the amount of toner concentration can be calculated by a controller.

As one option, the transparent viewing window 210 could be placed below the magnetic roller 46, at a spot where a magnetic brush is in intimate contact with the transparent viewing window 210 to ensure that any toner that is inadvertently deposited on the transparent viewing window 210 is also removed by the magnetic brush on a continuous basis. This would prevent a signal bias due to a contribution from the reflectivity of a toner layer on the transport viewing window 210, independent of the TC of the developer in the housing 44. One further modification that could be implemented to prevent a build-up of toner on the surface of the transparent viewing window 210 is to use a transparent viewing window 210 coated with a transparent conductive electrode, such as Indium tin oxide. The transparent viewing window 210 could then both bleed off excess charge deposited by the magnetic brush (which would cause development of toner to the transparent viewing window 210) and could also be biased, such as to put a cleaning field on the transparent viewing window 210 to further prevent toner build-up on the transparent viewing window 210.

In operation of the present invention the diffuse deflection is measured, and a signal is generated by a controller as a function thereof. The diffuse deflection measured is correlated to concentration of the toner particles and the carrier material by means such as a lookup table. As a result of the controller output, a dispensing signal to "add" toner particles from dispenser 39 into developer housing 44 of developer unit 38 is sent to maintain proper toner concentration and triboelectric properties within the developer unit 38.

An experiment was conducted to test the efficacy of the approach of the present invention. The sensor chosen was an Extended Toner Area Coverage Sensor (ETACS). This sensor is a reflection infrared densitometer that measures both reflected specular and diffuse light. The ETACS is an extension of the Xerox 5775/4850 families TAC sensor Xerox part no. (130K48252) Optimized Color Densitometer (OCD).

Experimental Procedure: Three magenta developer samples premixed to 2.5%, 4%, and 6.5% tc were poured in three separate heaps. A sheet of hard plastic material was placed over each heap of magenta developer. The intent was to simulate the view of developer that one would see if a transparent window was provided at or near the bottom of a developer housing. An ETACS LED intensity was set (1.8 volts) and the ETACS was placed in a spacing block to assure a fixed distance between the ETACS and the sample material. The ETAC was placed over the 2.5%, 4%, and then 6.5% developer heaps and diffuse and specular measurements were made. Obvious changes were not seen in the specular signal, so only the diffuse signal was recorded. The above process was repeated for black developer samples at 3.0% and 4.65% tc. The results are shown in the plot in FIG. 3. From the plot the sensitivity of magenta is approximately 200 mv/1% tc. The sensitivity of black is approximately 50 mv/1% tc. Black being less sensitive by a factor of about 4. The slope of the black is negative, suggesting that the addition of black toner, which has nearly zero diffuse reflection, simply reduces the diffuse reflectivity of the carrier.

Applicants have found that a carrier with substantially high diffuse reflectivity greater than 20 percent but preferably about 50 percent. (e.g. colored or "shiny" carrier) substantially improves the signal to noise ratio of the measurement when using black toner. This approach need not be limited to black toner. Improved robustness (optimization of the sensing technique) with other toners is possible. That is the signal to noise ratio of the diffuse reflectivity sensing technique may also be improved by modifying the carriers for magenta, yellow, cyan, or other pigmented toners. For example, if the difference between a colored toner diffuse reflectivity and the carrier diffuse reflectivity is substantially high say greater than 5 percent but preferably about 30 results improves signal to noise ratio. U.S. Pat. No. 4,989,985 provides a Table of the approximate reflective properties of selected toner materials at 880 nanometers incident wavelength.

| | SPECULAR REFLECTIVITY | DIFFUSE REFLECTIVITY |
|---|---|---|
| Yellow Toner | 0% | 60% |
| Magenta Toner | 0% | 64% |
| Cyan Toner | 0% | 44% |
| Black Toner | 0% | 1% |

Initial reduction to practice using a carrier coating containing a magenta pigment incorporated into a thermosetting polyurethane. The pigment is incorporated by extrusion at a temperature well below that of the cross-linking temperature of the polymer, with the subsequent carrier fusing process carried out at a temperature well above the cross-linking temperature. This process has been used in the past to coat carriers with the thermosetting urethane polymer Envirocron, in which a carbon black pigment has been dispersed in the coating. The charging properties of Envirocron based carrier coatings have been shown to be essentially equivalent to the polymethylmethacrylate coated carriers, so the resulting carrier is expected to be triboelectrically functional. Complete equivalence of triboelectric and electrical properties would require additional design work, possibly including incorporating low tint-strength conductive additives into the polymer as well (such as tin oxides or zinc oxides). Carrier coating stability (coating polymer staying on the core/core asperities expected to be minimized by the use of mechanically robust thermosetting polymers. Toner impaction on the carrier may also change the diffuse reflectivity properties as a function of developer age, but is likely to be stable and predicable enough to compensate for as the machine tracks developer age.

It is, therefore, apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A toner maintenance system for an electrophotographic developer unit, comprising:

a sump for storing a quantity of developer material comprised of toner material;

a member for transporting developer material from said sump, a viewing window, in communication with developer material, in said sump;

an optical sensor, for measuring reflected light off said viewing window and developer material, and means for generating a signal indicative of toner concentration in said sump, said optical sensor comprises an Extended Toner Area Coverage Sensor having means for detecting and analyzing both specular and diffuse electromagnetic energy reflected off said developer material.

2. A toner maintenance system according to claim 1, further comprising a toner concentration controller, said toner concentration controller adapted to receive a signal from said optical sensor and to generate an "Add Toner" signal to replenish toner in said sump.

3. A toner maintenance system according to claim 2, wherein said toner concentration controller includes means for correlating a diffuse measurement from said optical sensor to a toner concentration measurement.

4. A toner maintenance system according to claim 1, further comprising means for cleaning toner from said viewing window.

5. A toner maintenance system according to claim 1, further comprising means for cleaning said viewing window, said cleaning means includes a transparent conductive electrode being coated onto said viewing window and means for applying a bias to said transparent conductive electrode to repel toner therefrom.

6. An electrophotographic printing machine having a toner maintenance device in which a toner image is developed on a photoreceptive member, having a toner maintenance device, comprising:

a sump for storing a quantity of developer material comprised of toner material;

a member for transporting developer material from said sump, a viewing window, in communication with developer material, in said sump;

an optical sensor for measuring reflected light off said viewing window and developer material, and generating a signal indicative of toner concentration in said sump, said optical sensor comprises an Extended Toner Area Coverage Sensor having means for detecting and analyzing both specular and diffuse electromagnetic energy reflected off said developer material.

7. A toner maintenance system according to claim 6, further comprising a toner concentration controller, said toner concentration controller adapted to receive a signal from said optical sensor and to generate an "Add Toner" signal to replenish toner in said sump.

8. A toner maintenance system according to claim 7, wherein said toner concentration controller includes means for correlating a diffuse measurement to a toner concentration measurement.

9. A toner maintenance system according to claim 6, further comprising means for cleaning toner from said viewing window.

10. A toner maintenance system according to claim 6, further comprising means for cleaning said viewing window, said cleaning means includes a transparent conductive electrode being coated onto said viewing window and means for applying a bias to said transparent conductive electrode to repel toner therefrom.

11. An apparatus for measuring toner concentration of a sample composed of toner and carrier, the apparatus comprising:

a viewing window, in communication with the sample, an optical sensor for measuring reflected light off said viewing window and sample, and means for generating a signal indicative of toner concentration, said optical sensor comprises an Extended Toner Area Coverage Sensor having means for detecting and analyzing both specular and diffuse electromagnetic energy reflected off said developer material.

12. The apparatus of claim 11, further including means for correlating a diffuse light measurement from said optical sensor to a toner concentration measurement.

* * * * *